US009453428B2

(12) United States Patent
Lenherr

(10) Patent No.: US 9,453,428 B2
(45) Date of Patent: Sep. 27, 2016

(54) WATER/STEAM CYCLE AND METHOD FOR OPERATING THE SAME

(71) Applicant: ALSTOM Technology Ltd, Baden (CH)

(72) Inventor: Hans-Ulrich Lenherr, Lengnau/AG (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 191 days.

(21) Appl. No.: 14/341,113

(22) Filed: Jul. 25, 2014

(65) Prior Publication Data

US 2014/0331671 A1 Nov. 13, 2014

Related U.S. Application Data

(63) Continuation of application No. PCT/EP2013/052598, filed on Feb. 8, 2013.

(30) Foreign Application Priority Data

Feb. 10, 2012 (EP) ..... 12154846.5

(51) Int. Cl.

| | |
|---|---|
| ***F01K 9/00*** | (2006.01) |
| ***F28B 11/00*** | (2006.01) |
| ***F01D 19/00*** | (2006.01) |
| ***F01K 9/04*** | (2006.01) |

(Continued)

(52) U.S. Cl.

CPC ..... *F01D 19/00* (2013.01); *F01K 9/04* (2013.01); *F01K 13/02* (2013.01); *F28B 1/02* (2013.01); *F28B 9/10* (2013.01)

(58) Field of Classification Search

CPC ..... F01D 19/00; F28B 1/02; F28B 9/10; F01K 13/02; F01K 9/04

USPC ..... 60/661, 686, 693

See application file for complete search history.

(56) References Cited

U.S. PATENT DOCUMENTS 2,848,197 A 8/1958 Evans, Jr. et al.
4,776,170 A * 10/1988 Blangetti ..... B01D 19/001 60/685

(Continued)

FOREIGN PATENT DOCUMENTS

CH 423 819 A 5/1967
CN 1321529 A 11/2001

(Continued)

OTHER PUBLICATIONS

Russian Notice of Allowance Office Action issued in connection with Corresponding RU Application No. 2014136709 on Jan. 22, 2016.

*Primary Examiner* — Hoang Nguyen
(74) *Attorney, Agent, or Firm* — ALSTOM Power Inc.

(57) ABSTRACT

A water/steam cycle includes a steam generator, a steam turbine, a water cooled condenser and a feedwater pump. The condenser includes within a condenser shell at least one tube bundle with an internal air cooler, which is connected to an external ejector/vacuum pump by means of a suction line. In order to reduce the condenser evacuation time at the start-up of the water/steam cycle without using auxiliary steam, an additional evacuation line with a motorized isolating valve connects the external ejector/vacuum pump with the condenser shell. The action of the isolating valve is controlled by means of a control.

3 Claims, 2 Drawing Sheets

(51) Int. Cl.

| | |
|---|---|
| ***F01K 13/02*** | (2006.01) |
| ***F28B 9/10*** | (2006.01) |
| ***F28B 1/02*** | (2006.01) |

(56) References Cited

U.S. PATENT DOCUMENTS

| | | | | |
|---|---|---|---|---|
| 5,018,572 | A | 5/1991 | Blangetti et al. | |
| 5,749,227 | A * | 5/1998 | Smith | F01D 11/00 60/657 |
| 6,588,499 | B1 * | 7/2003 | Fahlsing | F28B 1/06 165/111 |
| 7,856,829 | B2 | 12/2010 | Shah et al. | |

FOREIGN PATENT DOCUMENTS

| | | | |
|---|---|---|---|
| CN | 101638997 | A | 2/2010 |
| CN | 201531280 | U | 7/2010 |
| DE | 44 22 344 | A1 | 1/1996 |
| EP | 0 325 758 | A1 | 8/1989 |
| EP | 0 384 200 | A1 | 8/1990 |
| EP | 0 841 527 | A2 | 5/1998 |
| EP | 0 976 998 | A1 | 2/2000 |
| JP | 2008267688 | A | 11/2008 |
| RU | 2268372 | C2 | 1/2006 |
| RU | 2269014 | C1 | 1/2006 |
| RU | 2320879 | C1 | 3/2008 |

* cited by examiner

WATER/STEAM CYCLE AND METHOD FOR OPERATING THE SAME

CROSS-REFERENCE TO RELATED APPLICATIONS

This application claims priority to PCT/EP2013/052598 filed Feb. 8, 2013, which claims priority to European application 12154846.5 filed Feb. 10, 2012, both of which are hereby incorporated in their entireties.

TECHNICAL FIELD

The present invention relates to the technology of power plants. It refers to a water/steam cycle according to the preamble of claim 1. It further refers to a method for operating such a water/steam cycle.

BACKGROUND

A water/steam cycle of a thermal power plant in general comprises—as shown in the schematic diagram of FIG. 1—steam generator 11, a steam turbine 12, a condenser 13 and a feedwater pump 15. The steam generator 11, which may be a heat recovery steam generator HRSG of a combined cycle power plant CCPP, generates steam by heating up feedwater, which is pumped to the steam generator 11 by means of the feedwater pump 15. The generated steam is used to drive the steam turbine 12, which may have high-pressure, intermediate pressure and low pressure stages. The steam, which leaves the steam turbine 12, is converted back into feedwater by means of the water cooled condenser 13 with its internal cooling water circuit 14. In order to keep the water/steam circuit 10 running with good efficiency and without malfunction, it is necessary to permanently remove from the cycle air and/or inert gases, which have entered the cycle through leaks, sealing, and the like. This is usually done by separating those gases from the steam, especially in the condenser 13, and pumping them down, e.g. with an external ejector/vacuum pump.

The configuration of a typical water cooled condenser 13 is shown in FIG. 3 (see the documents CH 423 819, EP 0 325 758 A1, EP 0 384 200 A1 and EP 0 841 527 A2). The condenser 13 comprises within a condenser shell 28 a plurality of separated tube bundles 18, which are arranged in parallel to allow the steam 16 that enters the condenser through an inlet section 17, to come into close thermal contact with the cooling water flowing through the tubes 19 of each tube bundle 18. The condensed steam is collected in a hot well 24 arranged below the tube bundles 18, and then led to the feedwater pump 15.

In the interior of each tube bundle 18 a cavity 20 is provided, which contains an air cooler 21 for finally separating the gases to be pumped down, from the remaining steam. The air coolers 21 are connected to an ejector/vacuum pump 25 via an internal piping 22 and a common suction line 23.

In the prior art, typically, auxiliary steam is used to seal the condenser and electric vacuum pumps are used to evacuate the condenser prior to start-up. However, these components are expensive and unreliable.

On the other hand, if no such additional components are used, suction side pressure losses reduce the performance of the ejector/vacuum pump 25 and substantially increase condenser evacuation time during start-up of the cycle. FIG. 2 shows in a diagram the pressure p as a function of time t during evacuation at the condenser 13 (curve A) and at the entrance of the ejector/vacuum pump 25 (curve B). As one can easily see from the diagram, there is a substantial pressure drop $\Delta p$ of app. 25% from the condenser 13 to the ejector/vacuum pump 25. As the mass flow for such a pump is roughly proportional to the suction pressure, the evacuation time is inversely proportional to the pressure drop $\Delta p$. As a consequence, a pressure drop of 25% gives an evacuation time, which is about 33% longer than without such a drop.

For a condenser of the type shown in FIG. 3, the pressure mainly has to two causes: on one hand, the air coolers 21 have small orifices (e.g. several hundred orifices of 7.5 mm diameter, each), which give a substantial flow resistance. On the other hand, the internal piping 22 of the condenser gives an additional restriction.

Document DE 44 22 344 A1 discloses a condenser which consists of a condensation chamber the bottom of which leads into a collecting chamber and of an additional vacuum chamber arranged at the side of the condensation chamber. The vacuum chamber leads also to the collecting chamber at the bottom and is separated from the condensation chamber by a wall. This wall has a passage for a syphon. The condensation chamber comprises within a condenser shell several tube bundles with an internal air cooler, which is connected to the vacuum chamber via a piping system, which is used to evacuate the condensation chamber from not condensing gas. The vacuum chamber itself is connected via an evacuation line with an external vacuum pump. The syphon forms an open reservoir which collects condensate from into the condensation chamber guided condensing steam. A fast start-up of the condenser is realized by evacuating the condensation chamber through the syphon by means of the vacuum pump. The syphon provides a natural stop of flow once the pressure gradient between the condensation chamber and the vacuum chamber has decreased and normal operation of the condenser has started.

The condenser disclosed in DE 44 22 344 A1 is much more complicated and more expensive than the standard condenser described before.

SUMMARY

It is an object of the present invention to avoid the drawbacks of the known condenser evacuation configurations and methods and provide a water/steam cycle and operating method, which minimize suction side pressure losses to maximize ejector/vacuum pump performance and to minimize condenser evacuation time as required by fast plant start-up without the use of auxiliary steam.

This and other objects are obtained by a water/steam cycle according to claim 1 and an operating method according to claim 3.

The water/steam cycle of the invention comprises a steam generator, a steam turbine, a water cooled condenser and a feedwater pump, whereby the condenser comprises within a condenser shell at least one tube bundle with an internal air cooler, which is connected to an external ejector/vacuum pump by means of a suction line, and whereby for reducing the condenser evacuation time at the start-up of the water/steam cycle without using auxiliary steam an additional evacuation line with an isolating valve to stop flow through said line during normal operation connects the external ejector/vacuum pump with the condenser shell. According to the invention the isolating valve is motorized and controlled by means of a control.

It is an advantage of the present invention that the condenser is unmodified standard. The only change is a nozzle somewhere on the shell for arranging the additional evacuation line.

According to an embodiment of the invention the additional evacuation line is connected to the suction line near the ejector/vacuum pump.

The inventive method for operating the water/steam cycle according to the invention comprises the steps of:

a) at a start-up of the water/steam cycle evacuating the condenser by means of the ejector/vacuum pump at least through the additional evacuation line;
b) stopping the flow through the additional evacuation line by closing the isolating valve within said additional evacuation line, wherein the isolating valve is motorized and the action of the isolating valve is controlled by means of control; and
c) commencing normal operation of the water/steam cycle.

BRIEF DESCRIPTION OF THE DRAWINGS

The present invention is now to be explained more closely by means of different embodiments and with reference to the attached drawings.

DETAILED DESCRIPTION

Figure 1:
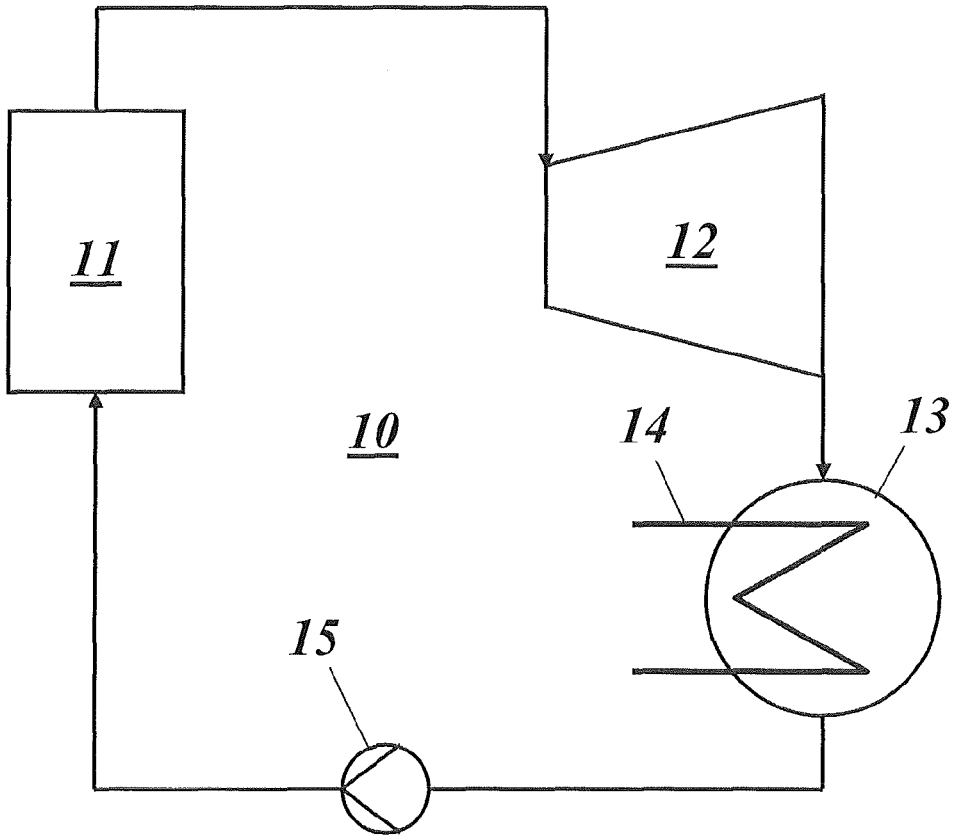
FIG. 1 shows a simplified diagram of a basic water/steam cycle.
Figure 2:
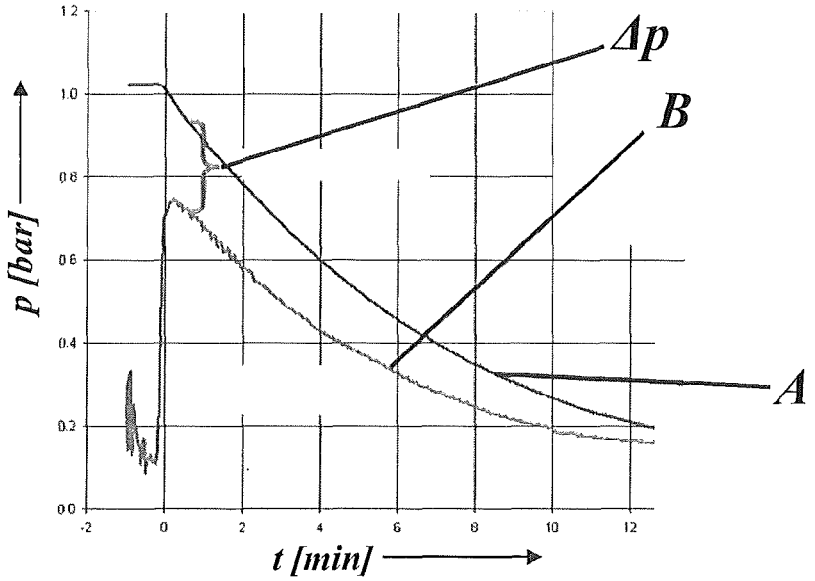
FIG. 2 shows in a diagram the pressure during evacuation of the condenser of FIG. 3 as a function of time at the condenser and at the entrance of the evacuation pump.
Figure 3:
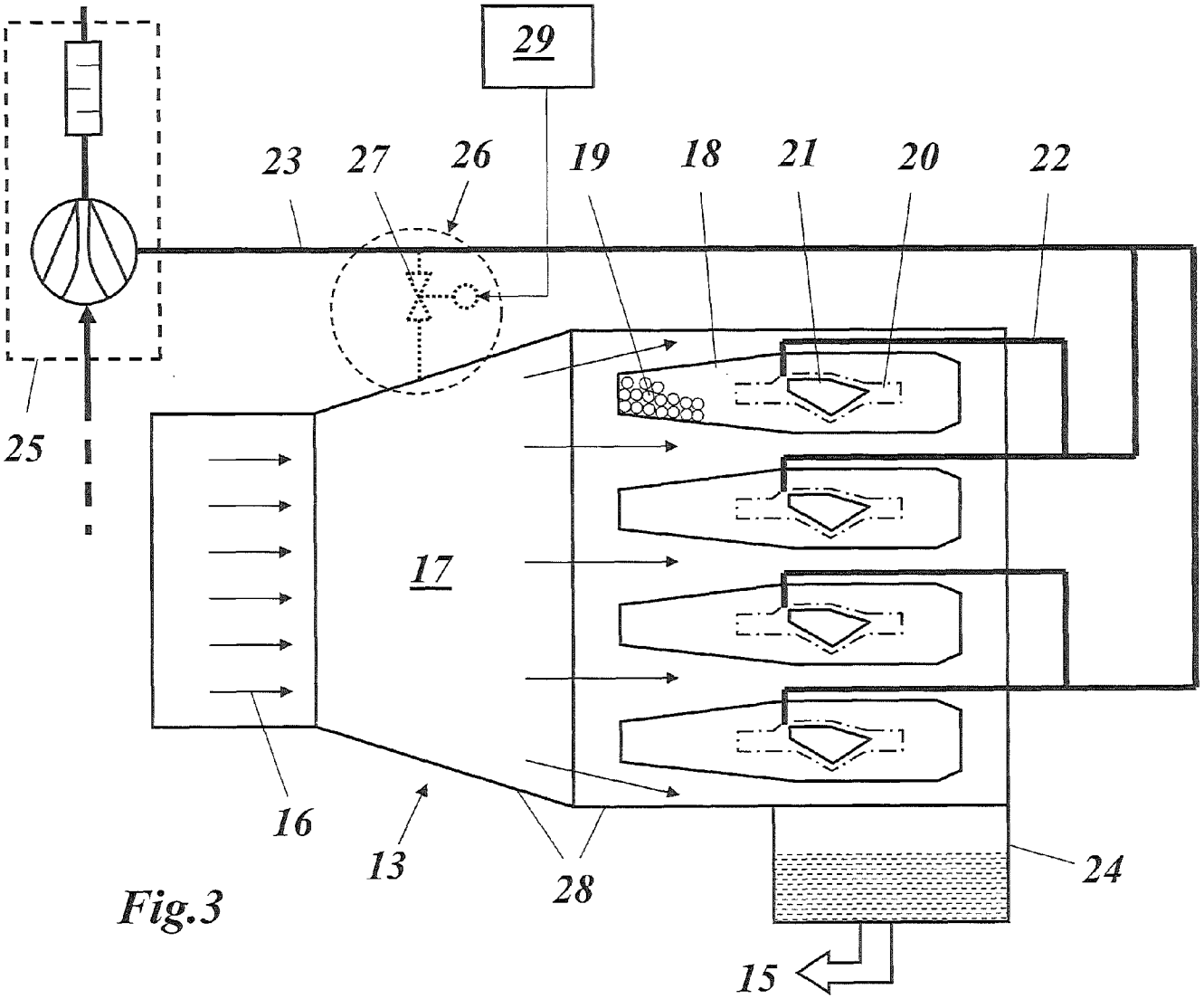
FIG. 3 shows a condenser/evacuation pump configuration according to an embodiment of the invention.

As can be seen in the dashed circle in FIG. 3, according to the invention, an additional evacuation or suction line 26 is provided between the condenser 13 and the ejector/vacuum pump 25. The additional evacuation or suction line 26 is used to minimize pressure loss in the evacuation piping (including condenser internals) of the water cooled condenser 13. This additional line 26 terminates at the condenser shell 28 and near the suction flange (entrance) of the ejector/vacuum pump 25. Furthermore, a motorized isolating valve 27 is installed in this line to stop flow during normal operation. The operation of the isolation valve 27 is thereby controlled by means of a control 29.

In operation, at a start-up of the water/steam cycle 10 the condenser 13 is evacuated with the first available steam by means of the ejector/vacuum pump 25 at least through the additional evacuation line 26 (and optionally the remaining evacuation piping) with the isolation valve 27 being open. When the pressure is low enough, the flow through the additional evacuation line 26 is stopped by closing the isolation valve 27 and the water/steam cycle 10 is started.

Thus, a reduced evacuation time can be realized without expensive additional equipment. Especially, an auxiliary steam supply is not needed to seal and evacuate the condenser prior to start-up (an auxiliary boiler would cost approximately 1 Mill € ). Furthermore, the used condenser is nearly unmodified standard without causing a lot of additional costs.

The invention claimed is:

1. Water/steam cycle comprising a steam generator, a steam turbine, a water cooled condenser and a feedwater pump, whereby the condenser comprises within a condenser shell at least one tube bundle with an internal air cooler, which is connected to an external ejector/vacuum pump by means of a suction line, and for reducing the condenser evacuation time at the start-up of the water/steam cycle without using auxiliary steam, an additional evacuation line connects the external ejector/vacuum pump with the condenser shell, and an isolating valve is provided within the additional evacuation line to stop flow through said line during normal operation, wherein said isolating valve is motorized and controlled by means of a control.

2. Water/steam cycle according to the claim 1, wherein the additional evacuation line is connected to the suction line near the ejector/vacuum pump.

3. Method for operating a water/steam cycle according to claim 1, comprising:

a) at a start-up of the water/steam cycle evacuating the condenser by means of the ejector/vacuum pump at least through the additional evacuation line;
b) stopping the flow through the additional evacuation line by closing an isolating valve within said additional evacuation line, wherein the isolating valve is motorized and the action of the isolating valve is controlled by means of control; and
c) commencing normal operation of the water/steam cycle.

* * * * *